US006960874B2

(12) United States Patent
Döll

(10) Patent No.: US 6,960,874 B2
(45) Date of Patent: Nov. 1, 2005

(54) TUBULAR DISCHARGE LAMP WITH IGNITION AID

(75) Inventor: Gerhard Döll, Ulm (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 201 days.

(21) Appl. No.: 10/432,160

(22) PCT Filed: Jul. 9, 2002

(86) PCT No.: PCT/DE02/02511

§ 371 (c)(1),
(2), (4) Date: May 20, 2003

(87) PCT Pub. No.: WO03/019616

PCT Pub. Date: Mar. 6, 2003

(65) Prior Publication Data

US 2004/0021411 A1 Feb. 5, 2004

(30) Foreign Application Priority Data

Aug. 17, 2001 (DE) ..... 101 40 356

(51) Int. Cl.[7] ..... H01J 61/35; H01J 61/42
(52) U.S. Cl. ..... 313/488; 313/489; 313/485

(58) Field of Search ..... 313/485, 486, 313/488, 489, 607, 234; 315/58, 326

(56) References Cited

U.S. PATENT DOCUMENTS

| | | | |
|---|---|---|---|
| 5,604,410 | A | 2/1997 | Vollkommer et al. |
| 6,097,155 | A | 8/2000 | Vollkommer et al. |
| 6,777,878 | B2 * | 8/2004 | Berlinghof et al. ..... 315/58 |
| 2001/0033483 | A1 | 10/2001 | Moore |

FOREIGN PATENT DOCUMENTS

| | | |
|---|---|---|
| DE | 42 03 594 | 10/1992 |
| DE | 100 48 410 | 4/2002 |
| EP | 0 387 615 | 9/1990 |

* cited by examiner

*Primary Examiner*—Karabi Guharay
(74) *Attorney, Agent, or Firm*—Robert F. Clark

(57) ABSTRACT

A dielectric barrier discharge lamp (1) having a tubular discharge vessel (2) and a luminescent material layer on at least a part of the inner wall of the discharge vessel (2) and having elongate electrodes (3) is provided with a coating (10) on a partial region of the inner wall at least at one end of the tubular discharge vessel (2), which coating additionally covers an end of at least one elongate electrode (3) . The material of the coating (10) has a high secondary electron emission coefficient. As a result, the ignition behavior of the lamp is improved, in particular during ignition in darkness.

20 Claims, 2 Drawing Sheets

D–D

TUBULAR DISCHARGE LAMP WITH IGNITION AID

TECHNICAL FIELD

The invention relates to a dielectric barrier discharge lamp having a tubular discharge vessel and a luminescent material layer.

Dielectric barrier discharge lamps are sources of electromagnetic radiation based on dielectrically impeded gas discharges.

The discharge vessel is usually filled with a noble gas, for example xenon or a gas mixture. So-called excimers are formed during the gas discharge, which is preferably operated by means of a pulsed operating method described in U.S. Pat. No. 5,604,410. Excimers are excited molecules, e.g. $Xe_2$*, which emit electromagnetic radiation upon returning to the generally unbonded ground state. In the case of $Xe_2$*, the maximum of the molecular band radiation lies at approximately 172 nm (VUV radiation). The luminescent material layer serves for converting the invisible VUV radiation into visible (VIS) radiation (light).

Lamps of this type are used in particular in apparatuses for office automation (OA), e.g. color copiers and scanners, for signal illumination, e.g. as braking and direction indicating lights in automobiles, for auxiliary illumination, e.g. the internal illumination of automobiles, and for the background illumination of displays, e.g. liquid crystal displays, as so-called "edge type backlights".

These technical fields of application require not only particularly short starting phases but also luminous fluxes that are as far as possible independent of temperature. Therefore, these lamps do not contain mercury.

The abovementioned applications require both a high luminance and a luminance that is uniform over the length of the lamp. For OA use, the inner wall of the discharge vessel is usually provided with a VUV/VIS reflection layer, for example $Al_2O_3$ and/or $TiO_2$. In this case, an aperture extending along the longitudinal axis of the lamp remains free of reflection layer since the VUV/VIS reflection layer is also opaque to the light emitted by the luminescent material layer. The actual luminescent material layer is situated on the VUV/VIS reflection layer, in which case the aperture may optionally likewise be coated with luminescent material or be free of luminescent material. In any event, the high luminance desired can be generated on account of the VUV/VIS reflection layer within the aperture free of reflection layer.

A dielectric barrier discharge lamp necessarily presupposes at least one so-called dielectrically impeded electrode. A dielectrically impeded electrode is isolated from the interior of the discharge vessel by means of a dielectric barrier. This dielectric barrier may be embodied, for example, as a dielectric layer covering the electrode, or it is formed by the discharge vessel of the lamp itself, namely if the electrode is arranged on the outer wall of the discharge vessel.

The dielectric barrier means that the operation of lamps of this type requires a time-variable voltage between the electrodes, for example a sinusoidal AC voltage or pulsed voltage as disclosed in U.S. Pat. No. 5,604,410 mentioned above.

PRIOR ART

U.S. Pat. No. 6,097,155 discloses a dielectric barrier discharge lamp of the type mentioned in the introduction.

The lamp has a tubular discharge vessel on whose inner and/or outer wall at least two elongate, conductor-track-like electrodes are arranged in a manner oriented parallel to the longitudinal axis of the discharge vessel. What is disadvantageous, however, is the long ignition delay after the application of the voltage to the electrodes of the lamp if the lamp is in darkness, for example within an OA apparatus. After some time in darkness, it can even happen that the lamp can only be ignited with a significantly increased voltage compared with normal operation.

DE-A 42 03 594 discloses a lamp with a discharge tube which has a transparent tube filled with a discharge gas and two electrodes which generate a spatial discharge in the tube, the two electrodes running essentially parallel along the length of the tube and one electrode being arranged centrally axially within the tube and the other outside the tube. In addition, the surface of the inner electrode and/or the inner side of the tube is coated with a coating material made of a metal with a high secondary emission ratio and/or a dielectric. Rare earth oxides, aluminum oxide ($Al_2O_3$), silicon oxide ($SiO_2$) or magnesium oxide (MgO) are used as coating material. The more preferred coating material is magnesium oxide, which can also act as a protective layer. What is disadvantageous about this lamp is firstly the shadowing by the bar-type inner electrode, and secondly the small proportion of the luminescent material layer relative to the total area of the inner wall of the discharge vessel, which inevitably leads to a loss of luminous flux of the lamp relative to the maximum possible luminous flux. This is because DE-A 42 03 594 provides for the upper half of the vessel inner wall along the discharge vessel to be coated with a luminescent material and the lower half with a layer with a high secondary electron emission coefficient (combination of the two figures 4A and 4B).

SUMMARY OF THE INVENTION

The object of the present invention is to provide a dielectric barrier discharge lamp having a tubular discharge vessel and a luminescent material layer in accordance with the preamble of claim 1 which has an improved ignition behavior.

In the case of a lamp having the features of the preamble of claim 1, this object if achieved by means of the features of the characterizing part of claim 1. Particularly advantageous refinements are found in the dependent claims.

The dielectric barrier discharge lamp according to the invention has a tubular discharge vessel and a luminescent material layer on at least a part of the inner wall of the discharge vessel. Moreover, elongate dielectrically impeded electrodes oriented parallel to the longitudinal axis of the discharge vessel are arranged on the vessel wall. At least one end of the tubular discharge vessel is provided with a coating on a partial region of the inner wall, which coating additionally covers an end of at least one elongate electrode, the material of said coating having a high secondary electron emission coefficient (referred to as SEE coating hereinafter for short). In this case, the SEE coating is in direct contact with the filling gas enclosed by the discharge vessel. Therefore, the SEE coating is always the last of, if appropriate, a plurality of functional layers on the inner wall of the discharge vessel, i.e. every further layer, for example luminescent material and/or VUV/VIS reflection layer, is arranged between SEE coating and the inner wall of the discharge vessel. It is ensured in this way that the SEE coating is hit by free electrons accelerated in the electric field of the electrodes and secondary electrons are thereby released.

The advantage of this solution is that a large part of the luminescent material layer, which is likewise applied on the inner wall of the discharge vessel, is uncoated, i.e. actually effective as well, since the SEE coating is limited to one or both ends of the tubular discharge vessel. Moreover, a slight shadowing at the lamp ends is less of a disturbance than, for instance, in the center of the lamp. Therefore, the SEE coating is also limited to the region at the end of at least one elongate electrode. In this case, it is unimportant, however, if the coating extends beyond the electrode end as far as the corresponding vessel end, since a discharge is no longer alight in this region anyway and, consequently, this region is dark. This dark region is therefore preferably kept as small as possible with respect to the total length of the lamp. That partial region of the inner wall which is provided with the coating preferably amounts to less than 25%, or better less than 10% of the total area of the inner wall along the longitudinal axis of the tubular discharge vessel, i.e. of the lateral surface.

In one embodiment, the SEE coating preferably overlaps an end of the elongate electrode, the overlap lying in the range of greater than 0 and less than or equal to 10 mm, preferably in the range of greater than 2 or less than or equal to 6 mm. Since, on account of the transverse discharge configuration, it is possible to operate lamps of different lengths, attention shall also be drawn at this point to the relative overlap, which typically lies in the range of greater than 0 and less than or equal to 20%, preferably in the range of greater than 0 and less than or equal to 10% of the total length of the lamp.

In the case of electrodes arranged on the inner wall of the discharge vessel (inner wall electrodes), as disclosed in U.S. Pat. No. 6,097,155 already mentioned, the overlap relates firstly to that end of the electrode which is opposite to the power feed. However, it goes without saying that the SEE coating can also cover the power-feed end of the electrode. At this point, it shall be pointed out only briefly that the inner wall electrode, the electrical feedthrough and the power feed are preferably realized as functionally different regions of a single conductor-track-like means. The conductor-track-like means itself has no structural separation into electrode, power feed, etc. Rather, the individual regions are defined by way of their function. The electrode is consequently the region of the conductor-track-like means which is situated within the discharge vessel. For further details in this respect, reference is made to U.S. Pat. No. 6,097,155 and the exemplary embodiments. In this regard, the term "overlap" is to be interpreted as covering at the power-feed end of an inner wall electrode.

A further advantage is that the lamp according to the invention can be produced in a relatively simple manner. Materials having a secondary electrode emission coefficient greater than one, in particular greater than two, preferably greater than 3, particularly preferably in the range between 3 and 15, are suitable for the SEE coating. By way of example, powder-like $Al_2O_3$ or MgO in a pasty preparation is particularly suitable. The relevant end of the lamp is then simply dipped into the paste until the desired overlap with the corresponding electrode end is achieved. In this case, the SEE coating has the outer form of a ring. The outer wall of the discharge vessel is advantageously covered during the dipping process.

In principle, however, it suffices for the improvement of the ignition behavior if the SEE coating is limited to a relatively small part of a ring, as long as the end of at least one electrode is thereby covered. This can be realized for example by using a suitable tool, e.g. a brush, to effect paste coating, possibly with the aid of a corresponding mask. A suitable mask is a thin-walled hollow cylinder or longitudinal part of a hollow cylinder whose external diameter corresponds approximately to the internal diameter of the discharge vessel. The wall of the hollow cylinder has an opening whose form corresponds to that of the coating to be applied. The hollow cylinder is introduced at the end of the tubular discharge vessel until the opening lies above the electrode end and then the paste is applied, within the opening, to the inner wall of the discharge vessel or the electrode end. After drying and possibly also baking of the paste, the mask can be removed again.

Moreover, it suffices, in principle, if at least one end of only a single electrode has an SEE coating. If the lamp is provided for operation with unipolar voltage pulses, the SEE coating must be arranged on the anode. This is because it is only then that primary electrons can be accelerated in the direction of the SEE coating and, on impinging there, secondary electrons can be released for the further development of the ignition process. This distinction is unimportant in the case of lamps for operation with bipolar voltage pulses, since the electrodes change their roles (instantaneous anode or cathode) in pairs depending on the polarity of the instantaneous voltage pulse.

Moreover, it is advantageous, in the case of bipolar operation, to provide the ends of both electrodes of an electrode pair with an SEE coating. This is because it is then ensured that, upon each voltage pulse, independently of the polarity thereof, the instantaneous anode is in any case provided with an SEE coating and a secondary electron emission can thus take place. Moreover, the probability of a rapid and reliable ignition is increased in the case of this variant.

Usually, but not necessarily, the discharge lamp according to the invention has a base at one or at both ends. The SEE coating is then advantageously arranged on that part of the inner wall of the discharge vessel which lies within the base, since, in this way, additional shadowing as a result of the SEE coating no longer occurs.

Furthermore, it may be advantageous to provide an SEE coating at both ends of the lamp, since the ignition then ideally proceeds from both ends. The probability of a rapid and reliable ignition is in any event increased in the case of this variant. In this case, it suffices, under certain circumstances, if the two coating zones are in each case narrower than in the case of the coating at only one end. Moreover, in the case of the variant coated on both sides, it may also be advantageous to design the coating zone to be wider in the base region than in the opposite baseless end. This variant combines the advantages of more intense ignition in the wide coating zone in the base region with little shadowing of the narrower coating zone at the baseless end of the lamp.

BRIEF DESCRIPTION OF THE DRAWINGS

The invention will be explained in more detail below using two exemplary embodiments. In the figures.

PREFERRED EMBODIMENT OF THE INVENTION

Figure 1A:
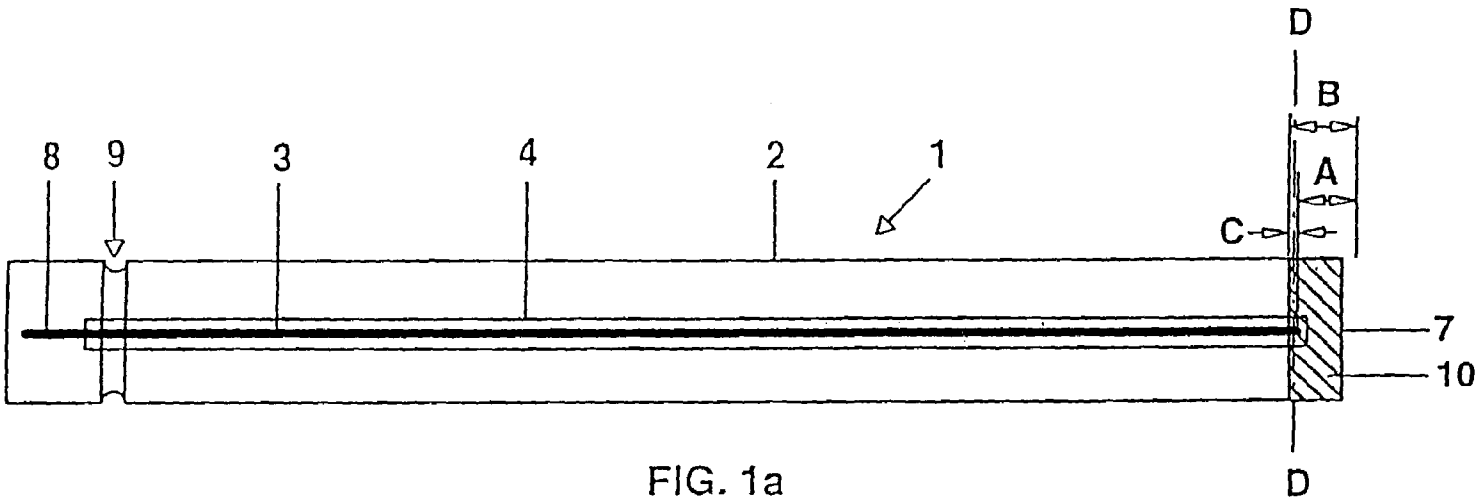
FIG. 1*a* shows a plan view of a first exemplary embodiment.
Figure 1B:
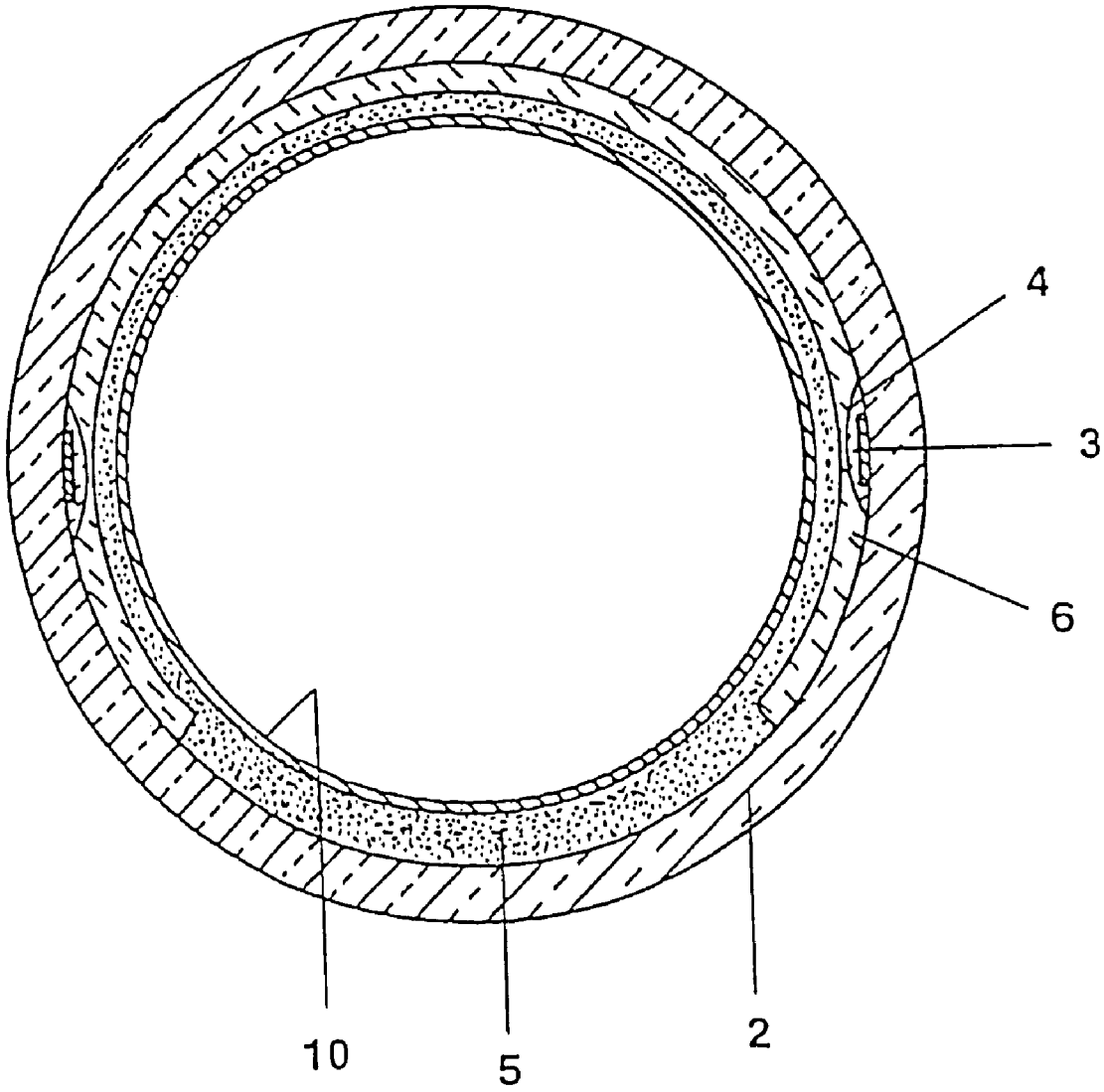
FIG. 1*b* shows a cross section of the exemplary embodiment from FIG. 1*a* along the line DD.

FIGS. 1*a* and 1*b* diagrammatically show a bar-type fluorescent lamp 1 in plan view and, respectively, in cross section along the line DD. The lamp 1 essentially comprises a tubular discharge vessel 2 made of soda lime glass with a circular cross section and also two strip-type electrodes 3 (the second electrode is concealed and therefore cannot be seen) made of silver solder, which are applied on the inner side of the wall of the discharge vessel 2 in a manner arranged parallel to the longitudinal axis of the tube and diametrically with respect to one another. Each of the inner wall electrodes 3 is covered with a dielectric barrier 4 made of glass solder. Furthermore, the inner side of the wall of the discharge vessel is covered with a luminescent material layer 5 and, with the exception of an aperture extending along the longitudinal axis of the lamp, with the VUV/VIS reflection layer 6 made of $Al_2O_3$ which lies below the luminescent material layer 5 (only shown in FIG. 1*b* for illustration reasons).

A first end of the discharge vessel 2 is sealed by means of a blunt fusion 7. The two electrodes 3 end at a distance A=5 mm before said fusion 7. The electrodes 3 are led outward in a gastight manner through the other end of the discharge vessel 2 and merge there in each case with an external power feed 8. The second end of the discharge vessel 2 is sealed by means of a plate-type closure element (not visible in this illustration). For this purpose, the edge of the plate-type closure element is fused with a constriction 9 of the discharge vessel 2. For further details in this respect, reference is made to DE-A 100 48 410 whose disclosure content is hereby incorporated by reference. By means of the above-mentioned technology, the inner wall electrode 3, the electrical feedthrough in the region of the constriction 9 and the power feed 8 are recognized as functionally different regions of a single conductor-track-like silver solder strip.

At the first end of the discharge vessel 2, an annular coating 10 of width B=10 mm—considered in the direction of the longitudinal axis of the discharge vessel 2—made of MgO (porous magnesium oxide) is applied on the inner wall, more precisely directly on the luminescent material layer 5. The annular MgO coating 10 on the one hand terminates directly with the end 7 of the discharge vessel 2 and was produced by dipping said vessel end into an MgO paste. On the other hand, the width B of the annular MgO coating 10 was chosen such that the ring covers the end of the electrodes 3 by the overlap C=5 mm (=B minus A). This ensures that the MgO ring 10, as secondary electron emitter, improves the ignition properties of the lamp 1. At the same time, the shadowing by the MgO ring 10 is limited to an annular partial region having the width B of just 5 mm. That is only approximately 1.5% relative to the total luminous length of the lamp 1 of 350 mm (measured from the constriction 9 to the end of the electrodes 3).

Figure 2:
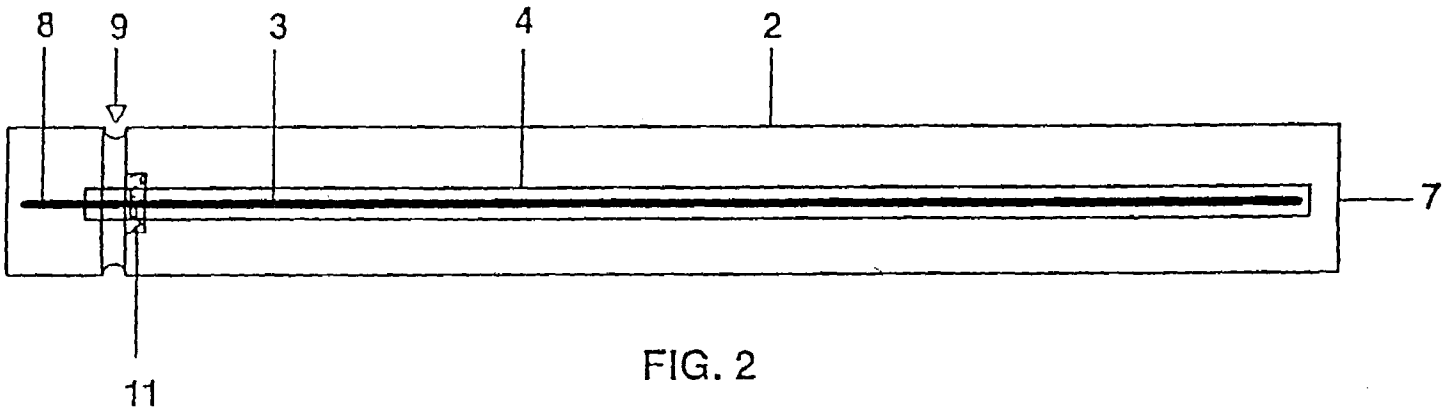
FIG. 2 shows a second exemplary embodiment.

FIG. 2 shows, in diagrammatic plan view, a variant of the embodiment of FIGS. 1*a*, 1*b* (identical features are provided with identical reference symbols), in which an MgO coating in the form of two short partial rings 11 having a width of 5 mm are applied on those ends of the two electrodes 3 which directly adjoin the plate seal or constriction 9. More precisely, each of the two partial rings 11 (one of the two partial rings 11 is concealed due to the illustration) is applied on the luminescent material covering the electrodes 3 or the dielectric 4. Moreover, this end of the lamp 1 is provided with a base (not illustrated) which covers the two MgO partial ends 11.

What is claim is:

1. A dielectric barrier discharge lamp (1) having a tubular discharge vessel (2), a luminescent material layer (5) on at least a part of the inner wall of the discharge vessel (2) and dielectrically impeded, elongate electrodes (3), which are arranged on the vessel wall in a manner oriented parallel to the longitudinal axis of the discharge vessel (2), at least one end of the tubular discharge vessel (2) is provided with a coating (10; 11) on a partial region of the inner wall, which coating additionally covers an end of at least one elongate electrode (3) and partially covers the luminescent material layer (5), the material of said coating (10; 11) having a high secondary electron emission coefficient.

2. The discharge lamp as claimed in claim 1, partial region of the inner wall which is provided with the coating (10; 11) amounting to less than 25% of the total area of the inner wall along the longitudinal axis of the discharge vessel (2).

3. The discharge lamp as claimed in claim 2, the coating having the outer form of a ring (10) or of at least a part (11) of a ring.

4. The discharge lamp as claimed in claim 2, the coating (10; 11) overlapping an end of at least one elongate electrode (3).

5. The discharge lamp as claimed in claim 1, the coating having the outer form of a ring (10) or of at least a part (11) of a ring.

6. The discharge lamp as claimed in claim 5, the coating (10; 11) overlapping an end of at least one elongate electrode (3).

7. The discharge lamp as claimed in claim 1, the coating (10; 11) having an overlap (D) with an end of at least one elongate electrode (3).

8. The discharge lamp as claimed in claim 7, the overlap (D) lying in the range of greater than 0 and less than or equal to 20%.

9. The discharge lamp as claimed in claim 7, the overlap (D) lying in the range of greater than 0 and less than or equal to 10%.

10. The discharge lamp as claimed in claim 7, the overlap (D) lying in the range of greater than 0 and less than or equal to 10 mm.

11. The discharge lamp as claimed in claim 1 with a base, the coating being arranged on that part of the inner wall of the discharge vessel which lies within the base.

12. The discharge lamp as claimed in claim 1, the lamp having at both ends a coating made of material with a high secondary electron emission coefficient.

13. The discharge lamp as claimed in claim 12 with a base at one end of the discharge vessel, the coating at the base end being wider in the direction of the longitudinal axis of the tubular discharge vessel than the coating at that end of the lamp which is remote from the base.

14. The discharge lamp as claimed in claim 1, the material of the coating (10; 11) having a secondary electron emission coefficient greater than one.

15. The discharge lamp as claimed in claim 1, the coating material (10; 11) comprising powder-like $Al_2O_3$ or MgO.

16. The discharge lamp as claimed in claim 1, at least one of the electrodes (3) being arranged on the inner wall of the discharge vessel (2).

17. The discharge lamp as claimed in claim 1, a VUV/VIS reflection layer (6) being arranged between the inner wall of the discharge vessel (2) and the luminescent material layer (5), an aperture extending along the longitudinal axis of the lamp being free of reflection layer.

18. The discharge lamp as claimed in claim 1, the partial region of the inner wall which is provided with the coating (10; 11) amounting to less than 10% of the total area of the inner wall along the longitudinal axis of the discharge vessel (2).

19. The discharge lamp as claimed in claim 1, the material of the coating (10; 11) having a secondary electron emission coefficient greater than 3.

20. The discharge lamp as claimed in claim 1, the material of the coating (10; 11) having a secondary electron emission coefficient in the range between 3 and 15.

* * * * *